US005758237A

United States Patent [19]

Abramsohn

[11] Patent Number: 5,758,237

[45] Date of Patent: May 26, 1998

[54] SYSTEM FOR ENHANCING VACUUM EFFICIENCY, PARTICULARLY FOR CONDITIONING LIQUID IMAGES IN A LIQUID DEVELOPING MATERIAL-BASED ELECTROSTATOGRAPHIC SYSTEM

[75] Inventor: Dennis A. Abramsohn, Pittsford, N.Y.

[73] Assignee: Xerox Corporation, Stamford, Conn.

[21] Appl. No.: 787,504

[22] Filed: Jan. 21, 1997

[51] Int. Cl.[6] ..... G03G 15/10

[52] U.S. Cl. ..... 399/249; 15/1.51; 15/256.52; 34/92; 34/95; 399/348

[58] Field of Search ..... 399/237, 249, 399/348, 98, 99, 102, 103, 355; 430/119, 125; 34/95, 361, 92; 492/12, 28; 15/1.51, 256.5, 256.52

[56] References Cited

U.S. PATENT DOCUMENTS

| | | | |
|---|---|---|---|
| 4,286,039 | 8/1981 | Landa | 430/119 |
| 5,028,964 | 7/1991 | Landa et al. | 399/390 |
| 5,276,492 | 1/1994 | Landa et al. | 399/249 |
| 5,332,642 | 7/1994 | Simms et al. | 430/125 |
| 5,481,341 | 1/1996 | Sypula et al. | 399/249 X |
| 5,493,369 | 2/1996 | Sypula et al. | 399/240 |
| 5,640,655 | 6/1997 | Shoji | 399/249 |

*Primary Examiner*—Arthur T. Grimley
*Assistant Examiner*—Sophia S. Chen
*Attorney, Agent, or Firm*—Denis A. Robitaille

[57] ABSTRACT

A system for removing excess carrier liquid from an electrostatic image developed with liquid developing material made up of toner particles immersed in a liquid carrier medium on an image bearing member. The system includes an absorbent contact roller for absorbing at least a portion of the liquid carrier off of the liquid image, a vacuum source coupled to the contact roller for generating negative pressure at the surface of the roller to draw the absorbed liquid through the contact roller, and a nonpermeable vacuum sealing membrane member partially surrounding the contact member in an area not adjacent to the image bearing surface for reducing the surface area of the contact roller which is exposed to the ambient atmosphere to create a vacuum sealing arrangement adapted to deliver negative pressure airflow to a selected area adjacent the image bearing surface.

20 Claims, 2 Drawing Sheets

Figure 1:
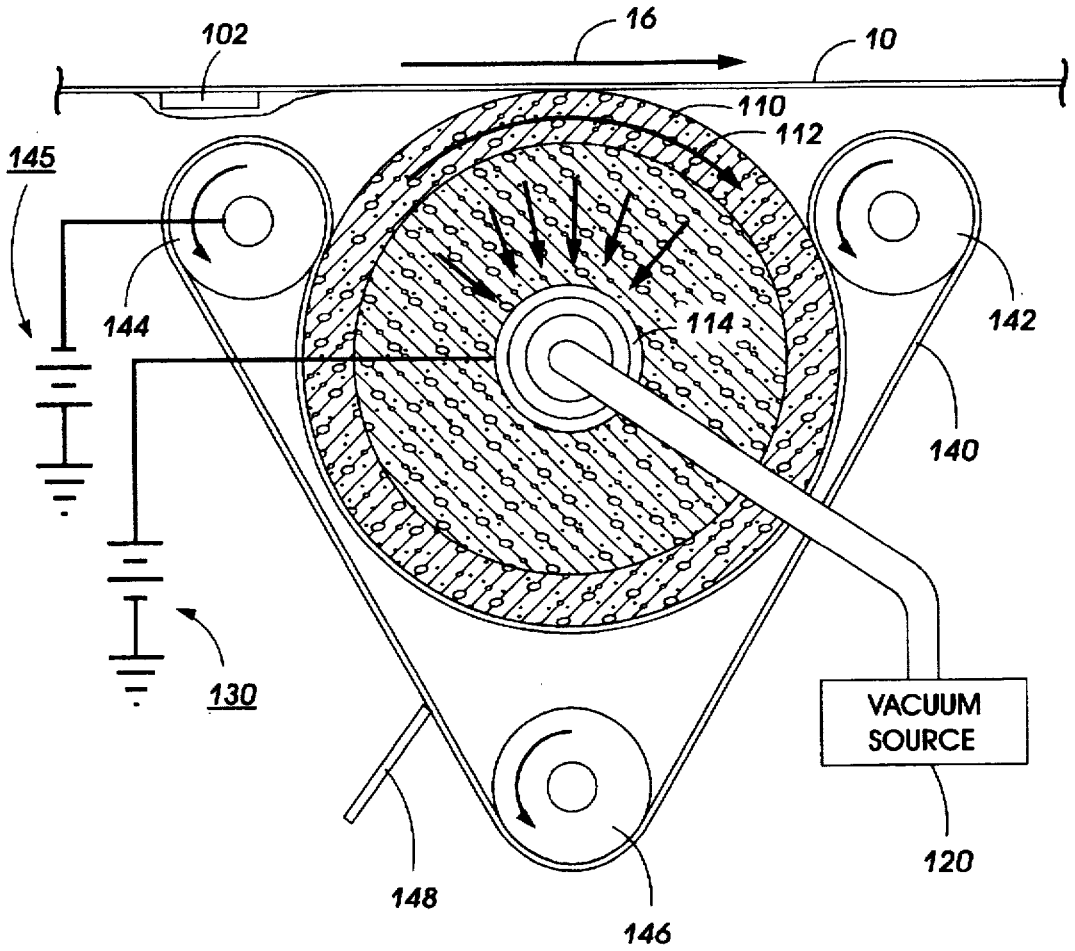

SYSTEM FOR ENHANCING VACUUM EFFICIENCY, PARTICULARLY FOR CONDITIONING LIQUID IMAGES IN A LIQUID DEVELOPING MATERIAL-BASED ELECTROSTATOGRAPHIC SYSTEM

This invention relates generally to a system for enhancing vacuum efficiency of a centrally evacuated permeable roller system, and more particularly, concerns an improved vacuum assisted apparatus for removing excess liquid from a developed liquid image on an image bearing surface in a liquid developing material based electrostatographic printing machine.

Generally, the process of electrostatographic copying is initiated by exposing a light image of an original document to a substantially uniformly charged photoreceptive member. Exposing the charged photoreceptive member to light in an imagewise configuration discharges the photoconductive surface thereof in areas corresponding to non-image areas in the original input document while maintaining charge in image areas, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developing materials comprising a liquid carrier having toner particles immersed therein have been successfully utilized to develop electrostatic latent images, wherein the liquid developing material is applied to the photoconductive surface with the toner particles being attracted toward the image areas of the latent image to form a developed liquid image on the photoreceptive member. Regardless of the type of developing material employed, the toner particles of the developed image are subsequently transferred from the photoreceptive member to a copy substrate, either directly or by way of an intermediate transfer member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

It has become highly desirable to provide the capability of producing multicolor output prints through the use of electrostatic printing processes. As such, a so-called subtractive color mixing process has been developed for use in electrostatographic printing machines to produce a multicolor output image, whereby a full gamut of colors is created from three colors, namely cyan, magenta and yellow. These colors are complementary to the three primary colors, with various wavelengths of light being progressively subtracted from white light.

Various methods can be utilized to produce a full process color image using cyan, magenta, and yellow toner images. One exemplary method of particular interest for producing a process color image is described as the Recharge, Expose, and Development (REaD) process, wherein different color toner layers are deposited in superimposed registration with one another on a photoreceptive member or other recording medium to create a multilayered, multicolored, toner image thereon. In this process, the recording medium is first exposed to record a latent image thereon corresponding to a subtractive color of an appropriately colored toner particle at a first development station. Thereafter, the recording medium having the first developed image thereon is recharged and re-exposed to record a latent image thereon corresponding to another subtractive primary color and developed once again with appropriately colored toner. The process is repeated until all the different color toner layers are deposited in superimposed registration with one another on the recording medium. Variations in this general technique for forming color copies, wherein a plurality of images are formed and developed to superimpose a plurality of toner images on one another are well known in the art, and may make advantageous use of the present invention.

Using the typical electrostatographic printing process as an example, the REaD color process described hereinabove may be implemented via either of two general architectures: a single pass, single transfer architecture, wherein multiple imaging stations, each comprising a charging unit, an imaging device, and a developing unit, are situated adjacent a single photoconductive belt or drum; or a multipass, single transfer architecture, wherein a single imaging station comprising the charging unit, an imaging device, and multiple developer units are located about a photoconductive belt or drum. As the names imply, the single pass architecture requires a single revolution of the photoconductive belt or drum to produce a color image, while the multipass architecture requires multiple revolutions of the photoconductive belt or drum to produce the color print or copy. Various other techniques and systems are known and have been successfully implemented, wherein each color separation is imaged and developed in sequence. Some of such known systems require that each developing station (except the first developing station) apply toner to an electrostatic latent image over areas of toner where a previous latent image has been developed, other systems actually transfer each image over to a second image support surface prior to imaging and development of a subsequent image on the photoreceptor.

As previously noted, the use of liquid developer materials in imaging processes is well known. Likewise, the art of developing electrostatographic latent images formed on a photoconductive surface with liquid developer materials is also well known. Indeed, various types of liquid developing materials and development systems have heretofore been disclosed with respect to electrostatographic printing machines. Liquid developers have many advantages, and often produce images of higher quality than images formed with dry developing materials. For example, the toner particles utilized in liquid developing materials can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

Liquid developer material typically contains about 2 percent by weight of fine solid particulate toner material dispersed in the liquid carrier, typically a hydrocarbon. After development of the latent image, the developed image on the photoreceptor may contain about 12 percent by weight of the particulate toner in the liquid hydrocarbon carrier. However, at this percent by weight of toner particles, developed liquid images tend to exhibit poor cohesive behavior which results in image smear during transfer and partial image removal, or so-called scavenging, during successive development steps, particularly in image-on-image color processes.

In order to prevent image scavenging and to improve the quality of transfer of the developed image to a copy sheet, the liquid developing material making up the developed liquid image is typically "conditioned" by compressing or compacting the toner particles in the developed image and removing carrier liquid therefrom for increasing the toner solids content thereof. This can be accomplished by either: conditioning the liquid ink making up the image into the image areas so as to physically stabilize the image on the photoreceptor or other image bearing surface; by conditioning liquid ink placed on the surface of the photoreceptor or other image bearing surface prior to the point where the image is developed with the liquid ink; or by conditioning the liquid ink stream as the ink is being delivered to the image bearing surface. Such liquid ink conditioning greatly improves the ability of the toner particles to form a high resolution image on the final support substrate or an intermediate transfer member, if one is employed.

Various devices and systems are known for effectively conditioning liquid developing materials in electrostatographic systems. In one exemplary system, a single electrically conductive roller member is urged against the photoconductive member bearing a liquid developed image. The contact pressure between the roller member and the photoconductor forces liquid to be wiped or squeegeed from image bearing surface while an electrical bias having a potential of the same polarity as the charged toner particles in the liquid developing material is applied to the roller such that the toner particles are repelled from the roller. By applying a biasing potential to the roller, toner particles are pushed away from the roller and into a compressed region on the surface upon which the developed image is being transported. In this type of system, the toner image may also be compacted by pressure contact of the roller against the image with the electrical bias applied to the roller repels the toner particles from the roller surface.

Although various devices have been developed for conditioning an image in liquid based electrostatographic printing systems, some problems and inadequacies remain with respect to known electrostatically based systems. Specifically, in the single biased squeegee roller arrangement of the type described above, limitations are imposed on the magnitude of the electrical bias applied to the roller due to the proximity of the roller to the photoconductive surface. In addition, because contact pressure is created between the roller and the photoconductive member, the roller profile is caused to vary which, in turn, generates variations in the electric field profile such that the electric field generated by the biased roller member is neither constant nor uniform. Also, in systems which employ some vacuum assisted mechanism to remove excess liquids in the presence of an air interface, the propensity of the vacuum to draw air instead of fluids due to the fluid's higher viscosity typically imposes a limit on the usable system pressure levels. These systems are also limited with respect to extended use due to clogging of the pores of the vacuum device, either by toner particles or contaminants which collect in the system.

The present invention is directed toward a system for enhancing vacuum efficiency and reducing air entrapment of a vacuum assisted liquid removal system including any centrally evacuated permeable roller system contemplated for use in extracting liquid from a wetted surface. More specifically, with respect to the field of liquid developing material-based electrostatographic copying and printing, the present invention is directed toward an electrostatic image conditioning device in which image compaction and liquid removal is accomplished with the assistance of a vacuum removal system, wherein negative air pressure is generated by a confined vacuum system to draw liquid carrier away from a developed liquid image on a photoreceptor or other image bearing surface. For purposes of the present discussion, negative air pressure will be defined as pressure between zero and the surround ambient environment, usually taken to be one atmosphere. The following disclosures may be relevant to some aspects of the present invention:

U.S. Pat. No. 4,286,039

Patentee: Landa et al.

Issued: Aug. 25, 1981

U.S. Pat. No. 5,028,964

Patentee: Landa et al.

Issued: Jul. 2, 1991

U.S. Pat. No. 5,276,492

Patentee: Landa et al.

Issued: Jan. 4, 1994

U.S. Pat. No. 5,493,369

Patentee: Sypula et al.

Issued: Feb. 20, 1996

The relevant portions of the foregoing patents may be briefly summarized as follows:

U.S. Pat. No. 4,286,039 discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 5,028,964 discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charged particles. The roller is charged to a potential having the same polarity as the charge of the toner particles of the liquid developer.

U.S. Pat. No. 5,276,492 discloses an imaging method and apparatus for transferring liquid toner images from an image forming surface to an intermediate transfer member for subsequent transfer to a final substrate, wherein the liquid toner images include carrier liquid and pigmented polymeric toner particles which are essentially nonsoluable in the carrier liquid at room temperature, and which form a single phase at elevated temperatures. That patent describes a method which includes the steps of; concentrating the liquid toner image by compacting the solids portion of the liquid toner image and removing carrier liquid therefrom; transferring the liquid toner image to the intermediate transfer member; heating the liquid toner image on the intermediate transfer member to a temperature at which the toner particles and the carrier liquid form a single phase; and transferring the heated liquid toner image to a final substrate.

U.S. Pat. No. 5,493,369 discloses a roller for improved conditioning of an image formed from a liquid developer comprised of toner particles and liquid carrier. A wire mesh uniformly covering an inner layer of the roller uniformly distributes an electrical bias closer to the surface of the roller and to the adjacent image bearing surface. The electrical bias has the same sign polarity as that of the toner particles of the image, to electrostatically repel and prevent the toner particles from entering the roller, and for compacting the toner particles to the image. The wire mesh reduces the electrical requirements of the materials used for the roller.

In addition to the above cited references, it is noted that various techniques have been devised for removing excess liquid carrier from an imaging member which may involve a vacuum removal system and/or an electrical bias applied to a portion of the liquid dispersant removal device. The following additional references may be relevant:

U.S. Pat. No. 4,878,090 discloses a development apparatus comprising a vacuum source which draws air around a shroud to remove excess liquid carrier from the development zone.

U.S. Pat. No. 5,023,665 discloses an excess liquid carrier removal apparatus for an electrophotographic machine. The apparatus is comprised of an electrically biased electrode having a slit therein coupled to a vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

U.S. Pat. No. 5,481,341 having a common assignee as the present application, discloses a belt used for absorbing liquid toner dispersant from a dispersant laden image on a electrostatographic imaging member or intermediate transfer member. The angle of contact of the absorption belt is adjusted with respect to the image bearing member for maintaining proper cohesiveness of the image and absorption of liquid dispersant. The absorption belt is passed over a roller biased with the same charge as the toner. A pressure roller is in contact with the absorption belt for removal of liquid therefrom.

U.S. Pat. No. 5,424,813, having a common assignee as the present application, discloses a roller comprising an absorption material and a covering, which are adapted to absorb liquid carrier from a liquid developer image. The covering has a smooth surface with a plurality of perforations, to permit liquid carrier to pass through to the absorption material at an increased rate, while maintaining a covering having a smooth surface which is substantially impervious to toner particles yet pervious to liquid carrier so as to inhibit toner particles from departing the image.

U.S. Pat. No. 5,332,642, having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

U.S. Pat. No. 5,352,558, having a common assignee as the present application, discloses a roller for removal of excess carrier liquid from a liquid developed image, comprising a rigid porous electroconductive supportive core, a conformable microporous resistive foam material provided around the core, and a pressure controller for providing a positive or negative pressure to the roller.

In accordance with one aspect of the present invention, there is provided a system for removing excess liquid from a liquid developed image having toner particles immersed in a liquid carrier on an image bearing surface, comprising: a contact member for contacting the liquid developed image on the image bearing member to remove at least a portion of the liquid carrier; a vacuum source coupled to the contact member for generating a negative pressure to induce air and liquid flow so as to draw removed liquid carrier through the contact member; and a nonpermeable membrane member partially surrounding the contact member in an area not adjacent to the image bearing surface for reducing surface area of the contact member which is exposed to atmosphere to create a vacuum sealing arrangement such that the reduced pressure induced air and liquid flow is delivered to a selected area. In one particular embodiment, this liquid removal system also includes a cleaning member for contacting the nonpermeable member, the cleaning member being adapted to remove residual parasitic solids or liquids from the surface of the nonpermeable member. In this embodiment, the nonpermeable membrane may be used to simultaneously selectively localize the area of vacuum enhancement while continuously cleaning the surface of the contact vacuum member. The cleaning of the contact vacuum member can be accomplished either by the random removal caused by continued contact between the membrane and the contact member or with an electrically biased roll which may be situated behind the belt to vacuum member interface.

In accordance with another aspect of the present invention, a liquid ink type electrostatographic printing machine is provided, including a system for removing excess liquid from a liquid developed image having toner particles immersed in a liquid carrier on an image bearing surface, comprising: a contact member for contacting the liquid developed image on the image bearing member to remove at least a portion of the liquid carrier; a vacuum source coupled to the contact member for generating a partial vacuum to draw removed liquid carrier through the contact member; and a nonpermeable membrane member partially surrounding the contact member in an area not adjacent to the image bearing surface for reducing surface area of the contact member which is exposed to atmosphere to create a vacuum sealing arrangement such that the partial vacuum induced negative air and liquid flow is delivered to a selected area.

In accordance with another aspect of the invention, a liquid developing material based electrostatographic printing machine including a system for removing excess liquid from a liquid developed image having toner particles immersed in a liquid carrier on an image bearing surface is provided, comprising: absorbent contact means for contacting the liquid developed image on the image bearing member to absorb at least a portion of the liquid carrier thereon; vacuum means coupled to the absorbent contact member for generating a negative pressure airflow adapted to draw absorbed liquid carrier through the absorbent contact member; and vacuum sealing means partially surrounding the absorbent contact means in an area not adjacent to the image bearing surface for creating a vacuum sealing arrangement to deliver the negative pressure air and fluid flow to a selected localized area adjacent to the image bearing surface.

In accordance with yet another aspect of the invention, there is provided an improved vacuum assisted permeable roller system for removal of liquid from a wetted a pface, comprising: a permeable roller member; a vacuum system coupled to the permeable roller member along a central core thereof for generating liquid and air flow through the roller member; and a vacuum sealing member partially surrounding the permeable roller member along a circumferencial surface thereof for selectively localizing the liquid and air flow to deliver a maximized negative pressure to a segment of the roller member adjacent to the wetted surface.

Figure 2:
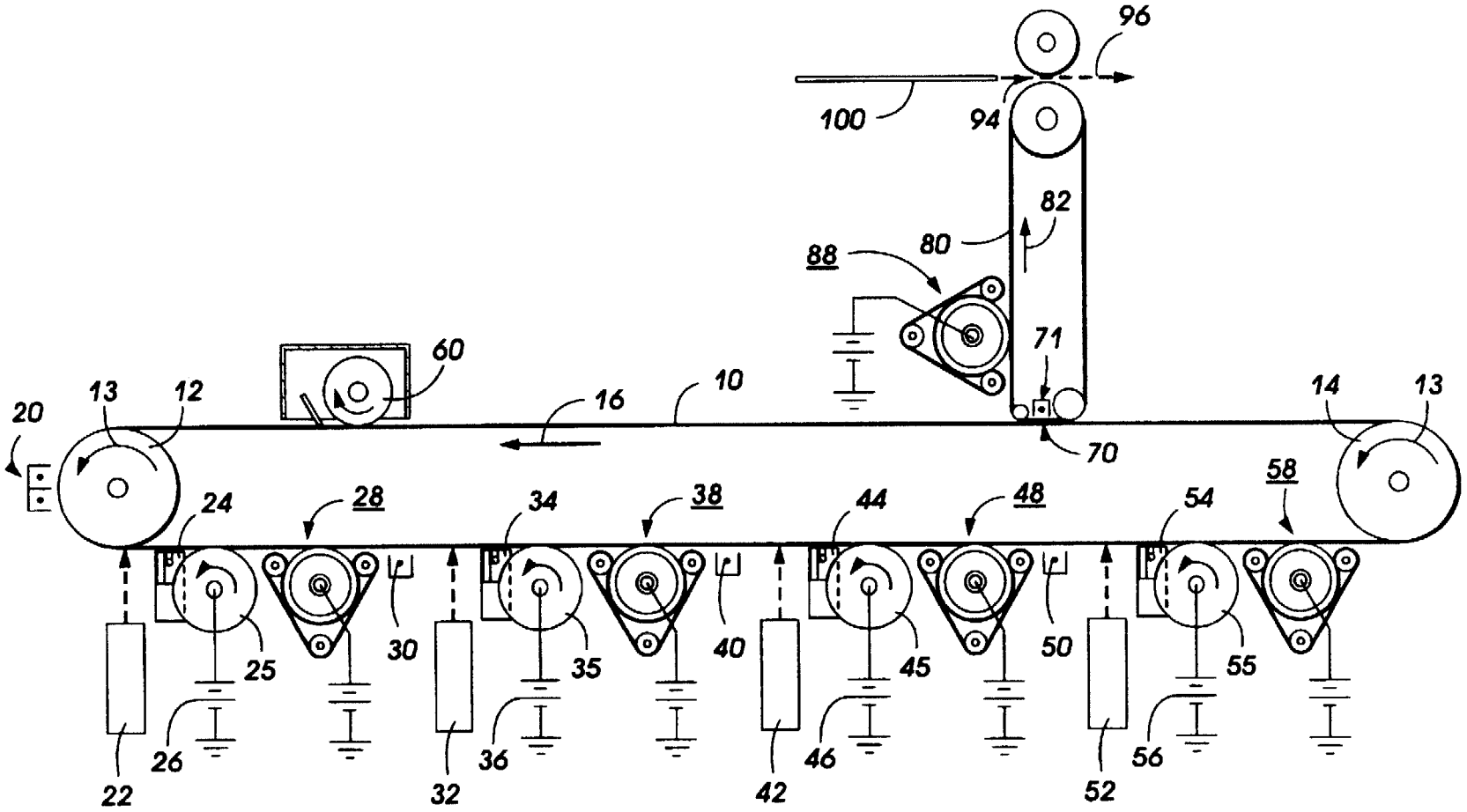

Other aspects of the present invention will become apparent as the following description proceeds and upon reference to the drawings, in which:

FIG. 1 is a schematic elevational view of an exemplary embodiment of a system for removing excess liquid from liquid developed images in accordance with the present invention; and FIG. 2 is a schematic, elevational view of a liquid ink-based image-on-image color electrostatographic printing machine incorporating a system for conditioning a liquid ink developed image in accordance with the present invention.

For a general understanding of the features of the present invention, reference is made to the drawings, wherein like reference numerals have been used throughout to designate identical elements. FIG. 2 shows a schematic elevational view of a full-color, liquid developing material based electrostatographic printing machine incorporating the features of the present invention. Inasmuch as the art of electrostatographic printing is well known, the various processing stations employed in the printing machine of FIG. 2 will be described briefly with reference thereto prior to a detailed description of the vacuum enhancing system. It will become apparent from the following discussion that the apparatus of the present invention may be equally well-suited for use in a wide variety of systems, devices, apparatus and machines and is not necessarily limited in its application to the field of electrostatographic printing or the particular liquid developing material-based electrostatographic machine described herein. As such, it will also be understood that the presently described system and method of vacuum containment and selective localization thereof, as provided by this invention, is not limited to use in printing engines but is capable of providing enhanced liquid removal from any wetted surface. Moreover, while the present invention will hereinafter be described in connection with preferred embodiments thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 2, the multicolor electrostatographic printing machine shown employs a photoreceptive belt 10 which comprises a multilayered structure, including a photoconductive surface deposited on an electrically grounded conductive substrate, wherein the photoconductive surface is preferably made from a selenium alloy and the conductive substrate is preferably made from an aluminum alloy. The photoreceptive belt 10 is transported along a curvilinear path defined by rollers 12 and 14. These rollers are spaced apart and may be rotatably driven in the direction of arrows 13 by a suitable motor or drive system (not shown) for advancing successive portions of the photoreceptive belt 10 sequentially through the various processing stations disposed about the path of movement thereof, in the direction of arrow 16.

Initially, the belt 10 passes through a charging station where a corona generating device 20 charges the photoconductive surface of belt 10 to relatively high, substantially uniform electrical potential.

After the substantially uniform charge is placed on the photoreceptive surface of the belt 10, the printing process proceeds by either placing an input document from a transparent imaging platen (not shown), or by providing a computer generated image signal for discharging the photoconductive surface in accordance with the image information to be generated. For multicolor printing and copying, the imaging process typically involves the separation of imaging information into individual color components for providing a series of subtractive imaging signals, with each subtractive imaging signal being proportional to the intensity of the incident light of each of the color components. These imaging signals are then transmitted to a series of individual raster output scanners (ROSs) 22, 32, 42 and 52 for generating complementary, color separated, latent images on the charged photoreceptive belt 10. Each ROS 22, 32, 42 and 52 typically writes the latent image information onto the photoreceptor in a pixel by pixel manner, as is well known in the art of electrophotography.

The present description is directed toward a Recharge, Expose, and Develop (REaD) process, wherein the charged photoconductive surface of photoreceptive member 10 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD), wherein charged areas are developed can be employed, as will be described. It will be recognized that this REaD process represents only one of various multicolor processing techniques that may be used in conjunction with the present invention, and that the present invention is not intended to be limited to REaD processing or to multicolor processes.

In the exemplary electrostatographic system of FIG. 2, each of the color separated electrostatic latent images are serially developed on the photoreceptive belt 10 via a fountain-type developing apparatus 24, 34, 44 and 54, which may be of the type disclosed in U.S. Pat. No. 5,579,473, wherein appropriately colored developing material is transported into contact with the surface of belt 10. By way of example, developer apparatus 24 transports cyan colored liquid developing material, developer apparatus 34 transports magenta colored liquid developing material, developer apparatus 44 transports yellow colored liquid developing material, and developer apparatus 54 transports black colored liquid developing material. Each different color developing material is comprised of charged toner particles disseminated through the liquid carrier, wherein the toner particles are attracted to the latent image areas on the surface of belt 10 by electrophoresis for producing a visible developed image thereon.

Generally, in a liquid developing material-based system, the liquid carrier medium makes up a large amount of the liquid developing composition. Specifically, the liquid medium is usually present in an amount of from about 80 to about 98 percent by weight, although this amount may vary from this range. By way of example, the liquid carrier medium may be selected from a wide variety of materials, including, but not limited to, any of several hydrocarbon liquids, such as high purity alkanes, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The toner particles can be any pigmented particle compatible with the liquid carrier medium, such as those contained in the developing materials disclosed in, for example, U.S. Pat. 3,729,419; 3,968,044; 4,476,210; 4,794,651; and 5,451,483, among numerous other patents. The toner particles preferably have an average particle diameter from about 0.2 to about 10 microns, and more precisely from about 0.5 to about 2 microns. The toner particles may be present in amounts of from about 1 to about 10 percent by weight, and preferably from about 1 to about 4 percent by weight of the developer composition. The toner particles can consist solely of pigmented particles, or may comprise a resin and a pigment; a resin and a dye; or a resin, a pigment, and a dye. Examples of suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® Conn., available from BASF, Printex® 140 V, available from Degussa, Raven® 5250 and Raven® 5720, available from Columbian Chemicals Company. Pigment materials may be colored, and may include magenta pigments such as Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for use in a liquid developing material based electrostatographic machine, a charge control additive (sometimes referred to as a charge director) may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

Continuing now with a discussion of the REaD multicolor printing process, as depicted in FIG. 2, the developer station may also include a metering roll 25, 35, 45, 55 situated adjacent to a corresponding developer fountain 24, 34, 44 and 54 and in close proximity to the surface of photoreceptive belt 10. The metering roll generally rotates in a direction opposite the movement of the photoconductor surface so as to exert a shear force on the liquid developed image in the area of the nip formed between the surface of the photoreceptor and the metering roll. This shear force removes an initial amount of liquid developing material from the surface of the photoreceptor so as to minimize the thickness of the developing material thereon. The excess developing material removed by the metering roll eventually falls away from the rotating metering roll for collection in a sump, not shown. A DC power supply 26, 36, 46, 56 may also be provided for maintaining an electrical bias on the metering roll at a selected polarity for enhancing image development. Each of the developer stations shown in FIG. 2 are substantially identical to one another and represent only one of various known apparatus or systems that can be utilized to apply liquid developing material to the photoconductive surface or other image recording medium.

After image development, the liquid developed image on the photoconductor 10 may be further processed to compress the image and to remove additional excess liquid carrier therefrom, as shown, for example, by U.S. Pat. Nos. 4,286,039 and 5,493,369, among various other patents. This so-called image conditioning process is directed toward increasing the solids percentage of the image, and can advantageously increase the solids percentage of the image to a range of approximately 25% or higher.

An exemplary apparatus for image conditioning is depicted at reference numerals 28, 38, 48 and 58, each comprising a roller member which preferably includes a porous body and a perforated skin covering. The image conditioning rolls 28, 38, 48 and 58 are typically biased to a potential having a polarity which inhibits the departure of toner particles from the image on the photoreceptor 10, while compacting the toner particles of the image onto the surface thereof. In an exemplary image conditioning system of U.S. Pat. No. 5,493,369, a vacuum source (not shown) may also be provided, coupled to the interior of the roller, for creating an airflow through the porous roller body to draw liquid carrier from the surface of the photoreceptor 10, thereby increasing the percentage of toner solids in the developed image.

In operation, rollers 28, 38, 48 and 58 rotate in contact with the liquid image on belt 10 such that the porous body of roller 28 absorbs excess liquid from the surface of the image through the pores and perforations of the roller skin covering. The vacuum source draws liquid through the roller skin to a central cavity, wherein the collected liquid may be deposited in a receptacle or some other location which permits either disposal or recirculation of the liquid carrier. The porous roller is thus continuously discharged of excess liquid to provide constant removal of liquid from the developed image on belt 10. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

As previously, the present invention is directed toward an improved vacuum assisted image conditioning device, wherein a nonpermeable membrane is provided in contact with and partially surrounding the porous roller to produce a vacuum sealing arrangement for reducing the amount of surface area of the roller which is exposed to the ambient environment, thereby producing higher vacuum pressure in the critical area adjacent the developed liquid image on the photoreceptor. This improved vacuum assisted image conditioning apparatus, and an exemplary vacuum sealing arrangement in accordance therewith, will be described in detail following the present description of the electrostatographic printing process.

Moving on the with the discussion of illustrative multicolor printing process, imaging, development and image conditioning are repeated for subsequent color separations by recharging and reexposing the belt 10, whereby color image information is superimposed over the previous developed image. For each subsequent exposure an adaptive exposure processing system may be employed for modulating the exposure level of the raster output scanner (ROS) 32, 42 or 52 for a given pixel as a function of the developing material previously developed at the pixel site, thereby allowing toner layers to be made independent of each other, as described in U.S. Pat. No. 5,477,317. The reexposed image is next advanced through a corresponding development station and subsequently through an associated image conditioning station, for processing in the manner previously described. Each step is repeated as previously described to create a multilayer image made up of black, yellow, magenta, and cyan toner particles as provided via each developing station. It should be evident to one skilled in the art that the color of toner at each development station could be provided in a different arrangement.

After the multilayer image is created on the photoreceptive member 10, it may be advanced to an intermediate transfer station 70 for transferring the image from the photoconductive belt 10 via charging devices 30, 40, and 50, and exposure devices 32, 42, and 52 to an intermediate transfer member, identified by reference numeral 80, for subsequent transfer to a copy substrate 100. A charging device such as a corona generating device 71, a biased transfer roller (not shown), or any other electrostatic or non-electrostatic transfer device may be provided for assisting image transfer to the intermediate member 80. Thereafter, the intermediate transfer member continues to advance in the direction of arrow 82 to a transfer nip 94 where the developed image is transferred and affixed to a recording sheet 100 transported through nip 94 in the direction of arrow 96. The intermediate member 80 may be provided in the form of either a rigid roll or an endless belt, as shown in FIG. 2, having a path defined by a plurality of transport rollers in contact with the inner surface thereof.

As noted hereinabove, the image on the photoreceptor 10, after image conditioning thereof, typically has a solids percentage in the range of approximately 25%. Similarly, therefore, the image transferred to the intermediate transfer member 80 has a solids percentage in the range of approximately 25%. However, the optimal solids content for transfer of a liquid image to a copy substrate is above approximately 50%. This solids percentage assures minimal hydrocarbon emissions from an image bearing copy substrate and further advantageously minimizes or eliminates carrier show through on the copy substrate. Thus, it is also desirable to remove excess liquid from the developed image on the intermediate 80, prior to transfer of that image to the copy sheet 100. To that end, prior to transfer of the image from the intermediate transfer member, the liquid developed image thereon may, once again, be conditioned in a manner similar to the image conditioning process described with respect to image conditioning apparatus 28, 38, 48 and 58. Thus, as shown in FIG. 2, an additional image conditioning apparatus 88 is provided adjacent the intermediate transfer member 80 for conditioning the image thereon.

The resultant conditioned multilayer image on the intermediate 80 may also be charged, for example, by exposure to a corona generating element (not shown) to insure that all of the toner particles making up the developed image are charged to the same polarity, thereby enhancing transfer efficiency by eliminating any toner particles that have become charged to a polarity opposite to that of the majority of the toner particles during the electrostatographic imaging process. Thereafter, transfer of the liquid developed image from the intermediate transfer member to the copy substrate 100 can be carried out by any suitable technique conventionally used in electrophotography, such as corona transfer, pressure transfer, bias roll transfer, and the like. In addition, transfer methods such as adhesive transfer, or differential surface energy transfer, wherein the receiving substrate has a higher surface energy with respect to the developing material making up the image, can also be employed.

After the developed image is transferred to intermediate member 80, residual liquid developer material may remain on the photoconductive surface of belt 10. A cleaning station 60 is therefore provided, which may include a roller formed of any appropriate synthetic resin which may be driven in a direction opposite to the direction of movement of belt 10, for scrubbing the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from a lamp (not shown) in preparation for a subsequent successive imaging cycle. In this way, successive electrostatic latent images may be developed.

The foregoing discussion provides a general description of the operation of a liquid developing material based electrostatographic printing machine which may advantageously incorporate the improved vacuum assisted image conditioning system of the present invention. The detailed structure of the improved vacuum assisted image conditioning system will be described hereinafter with reference to FIG. 1.

Referring now to FIG. 1 a preferred embodiment of the system for enhancing vacuum efficiency in accordance with the present invention will be described, with an understanding that the image conditioning systems shown in the multicolor electrostatographic printing system of FIG. 2, identified by reference numerals 28, 38, 48, 58 and 88, are substantially identical thereto. In general, the only major distinction between each image conditioning system is the liquid developed image being conditioned, with minor distinctions possibly being found in spacing and bias voltage levels due to toner pile height differences.

FIG. 1 depicts a preferred embodiment of an image conditioning system in accordance with the present invention, which generally includes a porous roller 110 in the form of an absorbent cylindrical contact roll member coupled to a vacuum source 120, wherein roller 110 is positioned in contact with the developed liquid image 102 for removing at least a portion of the liquid carrier therefrom. A high voltage bias supply 130 is also provided, connected to the support core 114 for generating an electrical field having the same polarity as that of the toner particles in the developed liquid image so that the toner particles are electrostatically repelled away from the surface of the roller 110. This electric field may also act to electrostatically compact the image on photoreceptor 10, enabling physical stabilization of the toner particles within the image area. One exemplary vacuum assisted porous roller system known in the art which may be effectively used to condition an image formed from a liquid developing material is generally disclosed in commonly assigned U.S. Pat. No. 5,332,642, incorporated herein by reference, wherein a negative pressure vacuum system is coupled to an absorbent blotter roller to draw off liquid carrier dispersant through the absorbent material which, in turn, removes excess carrier liquid from the developed liquid image.

Describing this vacuum assisted liquid removal apparatus in detail, roller 110 is comprised of a rigid porous support core 114 which may be in the form of a cylindrical tube having a hollow cavity extending along the entire length of the roller 110. A conformable, preferably microporous, absorbent material, which may include a permeable skin covering, surrounds the support core 114 for contacting the wetted surface, including image 102, from which liquid is to be removed. Vacuum source 120 is coupled to the central cavity of the porous support core 114 for creating a negative pressure air and fluid flow therethrough, extending through the absorbent material layer to the surface of the roller 110. The vacuum source 120 draws liquid carrier that has permeated into the absorbent material of roller 110 toward the central cavity of the support core 114. As illustrated in FIG. 1, in accordance with the present invention, a nonpermeable membrane 140 is provided for partially surrounding the roller 110, which will be described in greater detail herein. The nonpermeable membrane 140 of the present invention provides a means for reducing the amount of surface area of the roller which is exposed to the ambient atmospheric environment so as to create a vacuum sealing arrangement for selectively localizing the negative pressure air and fluid flow provided by vacuum source 130.

With respect to contact member 110, a preferred embodiment thereof includes a roller 110, having a porous supportive core 114 which may be made from a sintered metal, plastic, ceramic or other rigid material having sufficient rigidity and porosity for conditioning the liquid developed image. In addition, the material is preferably made to be electroconductive, either by itself or in combination with another conductive material, such that the electrical bias provided by supply 130 can be applied thereto to produce an electrical field which will result in a repelling force against the toner particles in the image area. In addition, the conformable microporous absorbent material making up roller 110 is preferably characterized by an open cell material which may comprise an absorbent polymeric and/or elastomeric foam material with conductive filler or dissipative filler incorporated therein. This material has a hardness is preferably from 20 to 60 Shore A, and has a thickness of 1.0 mils to 500 mils, preferably, about 40 mils to 250 mils. The absorption material of the microporous roller may be any suitable material, preferably a foam such as one selected from the group consisting of Polyurethane, Silicone, Fluorocarbon, Polyimide, Melamine, and rubber, such as Permair® (a microporous polyurethane material available from Porvair Ltd., England), and Tetratex® (a microporous semipermeable fluorocarbon membrane available from Tetratec Corp., Pennsylvania). Preferably, the absorbent material is electroconductive so that the electric field created by the bias source 130 applied to the core 114 is uniformly distributed along the surface of the roller 110 and the adjacent image bearing surface. A suitable level of resistivity for the absorbent material is in the range of $10^5$ to $10^{11}$ ohm-cm, and is preferably in the range of $10^6$ to $10^9$ ohm-cm.

The open cell pores of the absorbent material generally may be less than 1,000 microns in diameter, and preferably should be in the range of about 5 to about 300 microns, although various applications outside of the field of electrostatographic printing may certainly contemplate the use of pore sizes outside of these limits. Moreover, in the case of liquid developing material based electrostatographic applications, very small pores of one micron or less may be used to absorb liquid carrier from an image, resulting in a requirement for increased vacuum pressure necessary to extract an equivalent amount of liquid as that of a roller having larger size pores. Preferably, the porous absorbent layer is substantially impervious to toner particles while being pervious to liquid carrier for inhibiting the departure of toner particles from the image. An exemplary absorbent roller having a rigid porous electroconductive support core and a conformable microporous roller is described in commonly assigned U.S. Pat. No. 5,481,341, the relevant portions of which are hereby incorporated herein by reference. It is understood, however, that various and numerous materials known in the art may be satisfactorily used to meet the strength, porosity and conductivity requirements of the liquid extraction system of the present invention. The materials must, of course, be compatible with whatever liquid material is being removed.

Several advantages have been found in eliminating excess liquid carrier by vacuuming the liquid through a roller member, belt, or other contact member as opposed to other methods and apparatus found in the relevant art. For example, in a vacuum assisted system, less dispersant evaporates into the atmosphere, thereby reducing pollution and potential health risks to individuals working near the machine. In addition, since the liquid carrier can be reclaimed and reused, an efficient vacuum type blotter roller can yield cost advantages. Furthermore, a potential exists for the removed liquid to return back to the image bearing surface from the contact member which may be eliminated through the use of a vacuum assisted system, thereby eliminating potential disturbance of the image such that the final output image tends to be more clearly defined.

In operation, roller 110 rotates in direction 112 to encounter the "wet" image 102 on belt 10 (or intermediate 80). The absorbent layer of roller 110 absorbs excess liquid from the surface of the image through the porous skin covering, with the excess liquid permeating into the absorbent layer via vacuum enhanced capillary action. Vacuum source 120 is coupled to one end of the central cavity of the roller 110, drawing liquid that has permeated into the absorbent layer toward the central cavity of core 114 for transporting the liquid to a receptacle or some other location which will allow for either disposal or recirculation of the liquid carrier. Thus, porous roller 110, being continuously discharged of excess liquid, continues to rotate in direction 112 to provide continuous absorption of liquid from the image on belt 10. This process conditions the image by reducing the liquid content thereof while providing an increase in percent solids in the developed image, thereby improving the quality of the developed image.

As previously noted, the vacuum system 120 assists in drawing liquid carrier through the absorbent material of the roller 110 and into a central cavity thereof, where it may then be removed to a collection location. The vacuum system pressure must be adjusted so as to remove only liquid carrier from the image and so as to not have excessive suction force capable of also affecting the toner therein. It has been found that vacuum pressures ranging from about 0.5 inches of water to greater than 45 inches of water, and preferably within the range of 1.0 to about 15 inches of water have been suitable in electrostatographic applications. Problematically, however, prior art arrangements necessitate that the vacuum pressure and the speed of the roller 110 must be specifically selected to keep the pores of the roller 110 filled with liquid carrier material, such that the liquid carrier is absorbed into the roller at substantially the same rate as liquid carrier is removed therefrom. It is noted that capillary action in the porous roll helps initiate the movement of fluid through the roll and the assistance of the vacuum source 120 provides the continued fluid motion toward the central cavity thereof. However, when an excessively high vacuum pressure is used, the pores of the roll not in contact with the image become partially or totally cleared of liquid and thereafter draw air into the central cavity of the roller 110, thereby reducing the vacuum pressure and aerating the fluids collected therein. Even with somewhat lower vacuum levels, the pores may partially evacuate the liquid therein, creating an ambient air bubble within the pore such that that affected area will no longer act as a capillary for continuing the collection of fluid from the image.

The present invention overcomes the problem of evacuation, either partial or total, of liquid from areas of the roller not in contact with the image by the addition of a vacuum sealing member such as a nonpermeable membrane 140 operating as an external cover which may be in the form of a fixedly mounted sheet or an endless belt, as shown in FIG. 2, which is in contact with the permeable roller 110 over a significant portion of the circumference thereof in the area not adjacent to the image surface. In this configuration, the endless belt prevents the reduction of vacuum pressure inside the roll while eliminating the introduction of pressure and capillary reducing air pockets in the otherwise air exposed pores of the roller 110. This nonpermeable membrane 140 forms a vacuum sealing arrangement which prevents the vacuum source from clearing those pores located between the belt 140 and the central cavity, and therefore, maintains a high, selectively localized negative air and liquid flow in the critical region of liquid extraction adjacent the imaging surface. Thus, in the absence of the vacuum sealing arrangement of the present invention, vacuum pressures ranging from about 0.5 inches of water to greater than 45 inches of water have been suitable in electrostatographic applications because of limits caused by clearing the pores which are not adjacent to the image. With the present invention, higher vacuum pressures, up to 1 atmosphere, can be maintained across the contact roller.

FIG. 1, shows a three roll configuration in which the nonpermeable membrane 140 of the present invention is provided in the form of an endless belt which is entrained about rollers 142, 144, and 146. In this preferred embodiment, the membrane is situated so as to be in non-rolling, and moving contact with the vacuum roll 110. Thus, the combination of physical pressure against the vacuum roll and the differential vacuum pressure between the outside of the roll and the center of the roll act to hold the nonpermeable membrane 140 against the periphery of the vacuum roll 110, such that, as the vacuum roll is rotated with the image bearing surface for removing excess carrier liquid therefrom, the vacuum roll also drives the membrane 140, maintaining the belt 140. Rollers 142 and 144 operate to maintain the physical pressure and proximity of the membrane with the surface of the contact member 110. In this embodiment, the nonpermeable membrane 140 may be used to simultaneously selectively localize the area of vacuum enhancement while continuously cleaning the surface of the contact vacuum member. The cleaning of the contact vacuum member can be accomplished either by the random removal caused by continued moving contact between the membrane and the contact member or may be enhanced via an electrically biased roll (not shown) which may be situated in the vicinity of the belt to vacuum member interface.

In a further preferred embodiment, an electrical bias having a polarity opposite to the toner particles of the image 102 may be applied to roller 144 via biasing source 145 for attracting residual charged particles which may have become parasitically adhered to the vacuum roll. These residual toner particles are transferred onto the surface of the permeable membrane 140, where they are further transported to a cleaning blade 148, or any other suitable cleaning system, thereby preventing image degradation which may be caused by localized areas of low carrier fluid due to toner particles becoming trapped in the pores of the absorbent layer of contact member 110.

In an alternative embodiment, membrane 140 may preferably be situated so as to be in a fixed, low friction, low torque contact with the vacuum roll 110. As such, the vacuum sealing nonpermeable membrane 140 may include a peripheral surface having a low surface energy material for creating a low friction interface between the contact roll member 110 and the vacuum sealing membrane 140 such that the contact member rotates while the nonpermeable member remains in a fixed position relative to the rotating member. Potential materials for this application include a low friction polymer film such as silicone-polyester laminate, low surface energy materials such as polydimethylsiloxane, fluororesin, fluoropolymer and polytetrafluoroethylene or a semiconductive Tedlar® a registered trademark for a polyvinylfluoride film material available from E. I. DuPont deNemours of Wilmington, Del. The three rollers 142, 144 and 146 may be driven by the vacuum roller 110, or alternatively, one or more of these rollers 142, 144 or 146 may be driven by a motor or other drive source (not shown) to provide positive motion control for the belt system or to advantageously provide a drive system for the roller 110.

As previously noted, a cleaning blade may be provided adjacent an external surface of the belt 140, as indicated by blade 148, for removing any toner particles or other contaminants which may be offset from the image to roller 110 and subsequently to belt 140. This portion of the belt may be easily cleaned since the contact portion thereof is always on the outside of the three rollers 142, 144 and 146. Further, an electrified or electrostatic roll substituted for the exit roller can be used to remove contamination from the absorbent contact member to the endless belt and a cleaning blade or other cleaning member situated adjacent the surface of the endless belt for cleaning the surface thereof. It is also noted that various embodiments of the present invention may be envisioned by those of skill in the art, for example, a fixedly mounted drag sheet may be partially wrapped around a surface of the blotting roll 110.

In review, the present invention provides a system for enhancing the vacuum efficiency of a permeable vacuum roll system used to remove much of the liquid from a wetted surface. In particular, the system provides enhanced image conditioning of a liquid developed image being delivered to or on an image bearing surface in a liquid ink based electrostatographic printing machine, particularly an image-on-image type multicolor machine. The image conditioning system includes a vacuum assisted absorbent contact roll member having a nonpermeable membrane member partially surrounding the roll member for reducing the surface area thereof which is exposed to ambient atmosphere to create a vacuum sealing arrangement such that vacuum pressure is delivered to a selected localized area adjacent the liquid image.

It is, therefore, apparent that there has been provided, in accordance with the present invention, a system for enhancing the vacuum efficiency and reducing the air entrapment of any centrally evacuated permeable roller system for liquid removal from a wetted surface and particularly for conditioning liquid images on an image bearing surface in a liquid ink type multicolor electrostatographic printing machine, particularly an image-on-image type multicolor machine. The method and apparatus described herein fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

I claim:

1. A system for removing excess liquid developed image having toner particles immersed in a liquid carrier on an image bearing surface, comprising:

an absorbent contact member for contacting the liquid developed image on the image bearing surface to absorb at least a portion of the liquid carrier thereon;

a vacuum source coupled to said absorbent contact member for generating a negative pressure airflow adapted to draw absorbed liquid carrier through said absorbent contact member; and a vacuum sealing member partially surrounding said absorbent contact member, including an endless belt partially entrained about said absorbent contact member in an area not adjacent to the image bearing surface, for creating a vacuum sealing arrangement to deliver the negative pressure air and fluid flow to a selected localized area adjacent to the image bearing surface.

2. The system of claim 1, wherein said contact member includes a rigid porous core; and a porous absorbent material layer surrounding said rigid porous core.

3. The system of claim 2, wherein said porous absorbent material layer is substantially pervious to liquid carrier while being substantially impervious to toner particles for inhibiting toner particles from departing the liquid developed image.

4. The system of claim 1, further including an electrical biasing source coupled to said contact member for providing an electrical bias thereto having a polarity similar to a polarity of the toner particles to generate an electric field adapted to electrostatically repel and compress the toner particles towards the image bearing surface.

5. The system of claim 1, wherein said vacuum sealing member includes nonpermeable membrane.

6. The system of claim 1, further including a plurality of rotatable rollers configured to transport said endless belt in contact with said contact member.

7. The system of claim 1, further including a cleaning member situated adjacent a surface of said endless belt for cleaning the surface of the endless belt.

8. The system of claim 7, further including an electrically biased roll member for transferring residual contamination from said absorbent contact member to said endless belt.

9. The system of claim 1, wherein said vacuum sealing member includes a peripheral surface including a low surface energy material for creating a low friction interface between said contact member and said vacuum sealing member.

10. A liquid developing material based electrostatographic printing machine including a system for removing excess liquid from a liquid developed image having toner particles immersed in a liquid carrier on an image bearing surface, comprising:

an absorbent contact member for contacting the liquid developed image on the image bearing surface to absorb at least a portion of the liquid carrier thereon;

a vacuum source coupled to said absorbent contact member for generating a reduced pressure air and fluid flow adapted to draw absorbed liquid carrier through said absorbent contact member; and a vacuum sealing member partially surrounding said absorbent contact member, including an endless belt partially entrained about said absorbent contact member in an area not adjacent to the image bearing surface, for creating a vacuum sealing arrangement to deliver the reduced pressure air and fluid flow to a selected localized area adjacent to the image bearing surface.

11. The electrostatographic printing machine of claim 10, wherein said contact member includes a rigid porous core; and a porous absorbent material layer surrounding said rigid porous core.

12. The electrostatographic printing machine of claim 11, wherein said porous absorbent material layer is substantially pervious to liquid carrier while being substantially impervious to toner particles for inhibiting toner particles from departing the liquid developed image.

13. The electrostatographic printing machine of claim 10, further including an electrical biasing source coupled to said contact member for providing an electrical bias thereto having a polarity similar to a polarity of the toner particles to generate an electric field adapted to electrostatically repel and compress the toner particles towards the image bearing surface.

14. The electrostatographic printing machine of claim 10, wherein said vacuum sealing member includes nonpermeable membrane.

15. The electrostatographic printing machine of claim 10, further including a plurality of rotatable rollers configured to transport said endless belt in contact with said contact member.

16. The electrostatographic printing machine of claim 10, further including a cleaning member situated adjacent a surface of said endless belt for cleaning the surface of the endless belt.

17. The electrostatgraphic printing machine of claim 16, further including an electrically biased roll member for attracting contamination from the absorbent contact member to the endless belt.

18. The electrostatographic printing machine of claim 10, wherein said vacuum sealing member includes a peripheral surface including a low surface energy material for creating a low friction interface between said contact member and said vacuum sealing member.

19. An liquid developing material based electrostatographic printing machine including a system for removing excess liquid from a liquid developed image having toner particles immersed in a liquid carrier on an image bearing surface, comprising:

absorbent contact means for contacting the liquid developed image on the image bearing surface to absorb at least a portion of the liquid carrier thereon;

vacuum means coupled to said absorbent contact member for generating a negative pressure airflow adapted to draw absorbed liquid carrier through said absorbent contact member; and vacuum sealing means partially surrounding said absorbent contact means, including an endless belt partially entrained about said absorbent contact member, in an area not adjacent to the image bearing surface for creating a vacuum sealing arrangement to deliver the negative pressure airflow to a selected localized area adjacent to the image bearing surface.

20. An improved vacuum assisted permeable roller system for removal of liquid from a wetted surface, comprising:

a permeable roller member;

a vacuum system coupled to said permeable roller member along a central core thereof for generating liquid and air flow through said roller member;

a vacuum sealing member partially surrounding said permeable roller member, including an endless belt partially entrained about a circumferencial surface thereof for selectively localizing the liquid and air flow to deliver a maximized negative pressure to a segment of said roller member adjacent to the wetted surface.

* * * * *